US007002429B2

(12) United States Patent
Asao et al.

(10) Patent No.: US 7,002,429 B2
(45) Date of Patent: Feb. 21, 2006

(54) NONREFLECTIVE WAVEGUIDE TERMINATOR AND WAVEGUIDE CIRCUIT

(75) Inventors: Hideki Asao, Tokyo (JP); Yukitsugu Yoshino, Tokyo (JP); Kazuhisa Henmi, Tokyo (JP); Hideyuki Oohashi, Tokyo (JP); Yukihiro Tahara, Tokyo (JP); Hideo Ogawa, Tokyo (JP); Naofumi Yoneda, Tokyo (JP); Muneaki Mukuda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 79 days.

(21) Appl. No.: 10/685,507

(22) Filed: Oct. 16, 2003

(65) Prior Publication Data

US 2005/0017815 A1 Jan. 27, 2005

(30) Foreign Application Priority Data

Jul. 23, 2003 (JP) ..... 2003-200370

(51) Int. Cl.
*H01P 1/00* (2006.01)

(52) U.S. Cl. ..... 333/22 R; 333/248; 333/251; 333/81 B

(58) Field of Classification Search ..... 333/22 R, 333/248, 251, 81 B; 338/216
See application file for complete search history.

(56) References Cited

U.S. PATENT DOCUMENTS 2,722,661 A * 11/1955 Walker ..... 333/81 B
2,866,949 A * 12/1958 Tillotson ..... 333/1.1
2,937,346 A * 5/1960 Crowe ..... 333/24.1
3,568,194 A * 3/1971 Wilson et al. ..... 342/6
3,662,140 A * 5/1972 Jones et al. ..... 219/704
3,951,904 A * 4/1976 Tomonaga ..... 523/137
4,019,087 A * 4/1977 Hamada et al. ..... 315/3.5
4,618,865 A * 10/1986 Lamensdorf et al. ..... 343/776
4,906,952 A * 3/1990 Praba et al. ..... 333/22 R
4,985,708 A * 1/1991 Kelly ..... 343/771
5,276,448 A * 1/1994 Naito et al. ..... 342/4
5,469,128 A * 11/1995 Kawanishi et al. ..... 333/22 R
5,523,727 A * 6/1996 Shingyoji ..... 333/22 R
5,910,710 A * 6/1999 Simpson ..... 315/248
6,046,545 A * 4/2000 Horiuchi et al. ..... 315/39
6,094,106 A * 7/2000 Kishino et al. ..... 333/22 R
6,859,184 B1 * 2/2005 Ohtani et al. ..... 343/756

FOREIGN PATENT DOCUMENTS

JP 53113456 A * 10/1978

(Continued)

*Primary Examiner*—Robert Pascal
*Assistant Examiner*—Kimberly Glenn
(74) *Attorney, Agent, or Firm*—Oblon, Spivak, McClelland, Maier & Neustadt, P.C.

(57) ABSTRACT

A nonreflective waveguide terminator includes a waveguide portion and an electromagnetic wave absorber. The portion has a rectangular opening in a plane perpendicular to a radio-wave propagation direction. The portion has one open end in the direction and the other end closed by a terminating metal internal wall. The portion has a radio-wave propagation space surrounded by first and second metal internal walls parallel to a radio-wave electric field, and third and fourth metal internal walls perpendicular to the field. The exterior shape of the absorber is a parallelepiped. The absorber has a rear-end surface positioned at a predetermined distance from the terminating wall and parallel to the terminating wall or is provided against the terminating wall. The surface of the absorber having the largest rectangular area is on the third or the fourth metal internal wall.

10 Claims, 13 Drawing Sheets

FOREIGN PATENT DOCUMENTS

| | | | | |
|---|---|---|---|---|
| JP | 55-21675 | | | 7/1980 |
| JP | 55118201 | A | * | 9/1980 |
| JP | 574041005 | A | * | 3/1982 |
| JP | 60210003 | A | * | 10/1985 |
| JP | 62072202 | A | * | 4/1987 |
| JP | 1-204501 | | | 8/1989 |
| JP | 5-243817 | | | 9/1993 |
| JP | 9-162606 | | | 6/1997 |

* cited by examiner

NONREFLECTIVE WAVEGUIDE TERMINATOR AND WAVEGUIDE CIRCUIT

BACKGROUND OF THE INVENTION

1. Field of the Invention

The present invention relates to a nonreflective waveguide terminator and a waveguide circuit which transmit microwave and millimeter-wave signals.

2. Description of the Related Art

FIG. 16 is a perspective view showing the structure of a nonreflective waveguide terminator disclosed in, for example, Japanese Unexamined Patent Application Publication No. 5-243817. In a rectangular waveguide 1 having one short-circuited end, electromagnetic-wave absorbing plates 3 for absorbing a high frequency magnetic field are disposed on wall surfaces 2 which are parallel to an electric field inside the rectangular waveguide 1.

FIG. 17 is a perspective view showing the structure of a nonreflective waveguide terminator disclosed in Japanese Unexamined Patent Application Publication No. 5-243817. In a rectangular waveguide 1 having one short-circuited end, a tapered electromagnetic-wave absorber is disposed in the center of the rectangular waveguide 1 in a propagation direction of radio waves.

Next, the operation of the nonreflective waveguide terminator shown in FIG. 16 is described below.

Assuming that the left end of the waveguide 1 in FIG. 16 is an input port, an incident microwave signal is gradually absorbed by the electromagnetic-wave absorbing plates 3 disposed on planes parallel to the electric field in the waveguide 1. The electric field distribution is concentrated in the center of the cross-section of the rectangular waveguide 1. Thus, by reducing the thickness of the electromagnetic-wave absorbing plates 3, reflection of the microwave signal can be suppressed to a low level. Accordingly, in the design of the electromagnetic wave absorbing plates 3, the plate thickness is reduced and the length of the electromagnetic-wave absorbing plates 3 in the propagation direction of the microwave signal is set in order to obtain a predetermined absorption for no reflection according to the reduced thickness. This structure is suitable for a nonreflective waveguide terminator which is rectangular and for high power because it has a reduced electromagnetic wave absorption per unit volume and an enlarged radiation area in contact with the wall surfaces 2, which are parallel with the electric field.

Next, the operation of the nonreflective waveguide terminator shown in FIG. 17 is described below.

Assuming that the left end of the waveguide 1 in FIG. 17 is an input port, an incident microwave signal is gradually absorbed by the tapered electromagnetic-wave absorber 4 while reducing reflection. Compared with the nonreflective waveguide terminator in FIG. 16, the nonreflective waveguide terminator in FIG. 17 has a low radiating effect since it has a smaller area in contact with the internal wall surfaces. However, since the tapered shape determines the reflection characteristics, there is a possibility that the length of the nonreflective waveguide terminator in the propagation direction of the microwave signal may be reduced.

In the structure of the nonreflective waveguide terminator in FIG. 16, in the case of reducing reflection in the electromagnetic-wave absorbing plates 3, the plate thickness must be reduced for the purpose of lowering discontinuities caused by the end faces of the electromagnetic-wave absorbing plates 3. In the case of obtaining predetermined reflection characteristics, the length of the electromagnetic wave absorbing plates 3 in the propagation direction of the microwave signal must be increased so that the required electromagnetic wave absorption is obtained. Accordingly, the nonreflective waveguide terminator in FIG. 16 has a problem in that the length of the electromagnetic-wave absorbing plates 3 must be increased in order to obtain a predetermined reflection level or less, even if it is more than enough for the length required for high-power tolerant performance such as heat radiation performance. Also, the nonreflective waveguide terminator in FIG. 17 suffers from a problem of high production costs because it is difficult to perform processing of the tapered electromagnetic wave absorber 4.

SUMMARY OF THE INVENTION

The present invention is made in order to solve the above problems. It is an object of the present invention to provide a small and light nonreflective waveguide terminator which has good high-power tolerant performance and which is produced at a low production cost.

According to an aspect of the present invention, a nonreflective waveguide terminator is provided which includes: a waveguide portion having a rectangular opening in a plane perpendicular to a radio-wave propagation direction, the waveguide portion having one open end in the radio-wave propagation direction and the other end closed by a terminating metal internal wall, the waveguide portion having a radio-wave propagation space surrounded by a first metal internal wall and a second metal internal wall opposite thereto which include the shorter sides of the rectangular opening and which are parallel to a radio-wave electric field, and a third metal internal wall and a fourth metal internal wall opposite thereto which include the longer sides of the rectangular opening and which are perpendicular to the radio-wave electric field; and an electromagnetic wave absorber whose exterior shape is a parallelepiped, the electromagnetic wave absorber having a rectangular rear-end surface which is positioned at a predetermined distance from the terminating metal internal wall and parallel to the terminating metal internal wall or is provided against the terminating metal internal wall, the surface of the electromagnetic wave absorber, which has the largest rectangular area, being on one of the third metal internal wall and the fourth metal internal wall.

According to another aspect of the present invention, a waveguide circuit including a plurality of waveguide functional portions is provided. The waveguide functional portions each include a nonreflective waveguide terminator including: a waveguide portion having a rectangular opening in a plane perpendicular to a radio-wave propagation direction, the waveguide portion having one open end in the radio-wave propagation direction and the other end closed by a terminating metal internal wall, the waveguide portion having a radio-wave propagation space surrounded by a first metal internal wall and a second metal internal wall opposite thereto which include the shorter sides of the rectangular opening and which are parallel to a radio-wave electric field, and a third metal internal wall and a fourth metal internal wall opposite thereto which include the longer sides of the rectangular opening and which are perpendicular to the radio-wave electric field; and an electromagnetic wave absorber whose exterior shape is a parallelepiped, the electromagnetic wave absorber having a rectangular rear-end surface which is positioned at a predetermined distance from the terminating metal internal wall and parallel to the terminating metal internal wall or is provided against the terminating metal internal wall, the surface of the electromagnetic wave absorber, which has the largest rectangular area, being on one of the third metal internal wall and the fourth metal internal wall.

DESCRIPTION OF THE PREFERRED EMBODIMENTS

First Embodiment

A first embodiment of the present invention is described below with reference to the accompanying drawings.

Figure 1:
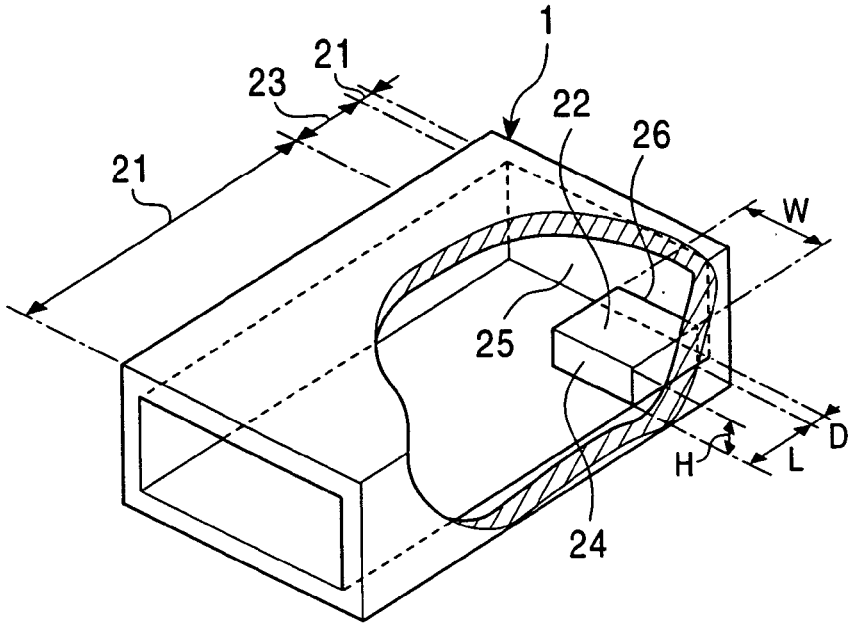
FIG. 1 is a perspective view showing a nonreflective waveguide terminator according to a first embodiment of the present invention.

FIG. 1 shows a rectangular waveguide 1 having one short-circuited end, and a parallelepiped electromagnetic wave absorber 22. The rectangular waveguide 1 can be divided into rectangular waveguide portions 21 where the electromagnetic wave absorber 22 is not provided along the radio-wave traveling direction, and a rectangular waveguide portion 23 where the electromagnetic wave absorber 22 is provided. The electromagnetic wave absorber 22 is disposed on a wall surface perpendicular to the electric field in the rectangular waveguide 1. For the electromagnetic wave absorber 22, material obtained by using epoxy resin to bind metal powder such as iron powder, and ceramic material such as ferrite are used. The electromagnetic wave absorber 22 is fixed to the wall surface of the rectangular waveguide 1 by using, for example, a silicon-rubber-based adhesive.

The rectangular waveguide 1 has a rectangular opening in a plane perpendicular to the radio-wave traveling direction. One end of the rectangular waveguide 1 in the radio-wave traveling direction is open, and the other end is closed by a short-circuiting circuit 25, which is a terminating metal internal wall. The radio-wave transmission space in the rectangular waveguide 1 is surrounded on all sides by a first metal internal wall and a second metal internal wall opposite thereto, which are parallel to the electric field of the radio waves and which include the shorter sides of the rectangular opening, and a third metal internal wall and a fourth metal internal wall opposite thereto, which are perpendicular to the electric field of the radio waves and which include the longer sides of the rectangular opening. The electromagnetic wave absorber 22 has an exterior parallelepiped shape having length L, height H, and width W. The electromagnetic wave absorber 22 has a rear-end surface (having height H and width W) at a predetermined distance D from the terminating metal internal wall parallel to the terminating metal internal wall. The surface of the electromagnetic wave absorber 22 having the largest area (having length L and width W) is on the third or fourth metal internal wall.

Next, the operation of the first embodiment is described below with reference to FIG. 2.

Figure 2:
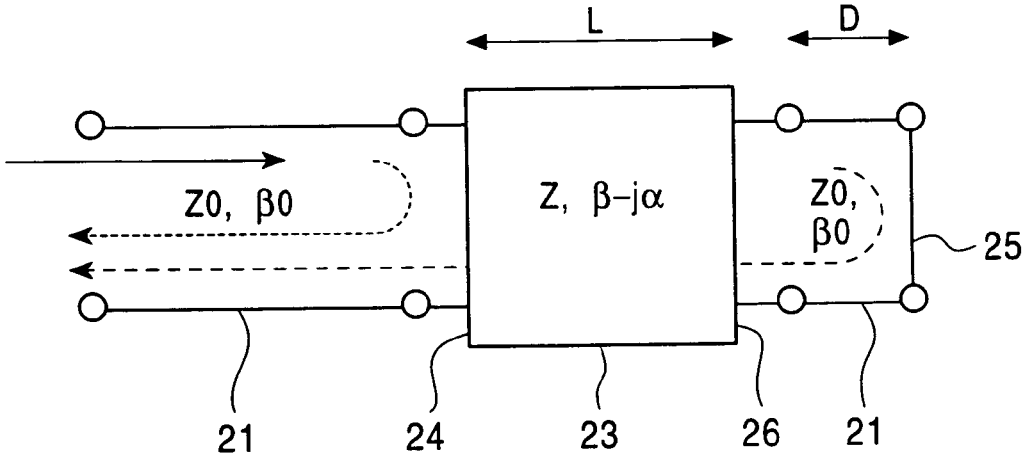
FIG. 2 is an equivalent-distribution-constant line-circuit diagram illustrating the operation of the nonreflective waveguide terminator according to the first embodiment.

FIG. 2 is an equivalent circuit diagram illustrating the operation of the nonreflective waveguide terminator of the present invention. Since the radio-wave transmission characteristics of the waveguide differ depending on whether an electromagnetic wave absorber is provided, the waveguide nonreflection terminator in FIG. 2 is divided into the rectangular waveguide portions 21 where the electromagnetic wave absorber 22 is not provided and the rectangular waveguide portion 23 where the electromagnetic wave absorber 22 is provided. In FIG. 2, the characteristic impedance and propagation constant of the rectangular waveguide portion 21 where the electromagnetic wave absorber 22 is not provided are indicated by symbols Z0 and β0, respectively. Also, the characteristic impedance and propagation constant of the rectangular waveguide portion 23 where the electromagnetic wave absorber 22 is provided are indicated by symbols Z and $\beta$-j$\alpha$, respectively, where $\beta$ represents a phase constant, a represents an attenuation constant, and j represents an imaginary unit. The symbol $\beta$-j$\alpha$ indicates that the microwave signal is propagated in the rectangular waveguide portion 23 while being attenuated.

Part of a microwave signal incident from the left side of FIG. 2 is reflected in the front 24 of the rectangular waveguide portion 23 where the electromagnetic wave absorber 22 is provided. The rest of the microwave signal reaches the short-circuiting circuit 25 while part of the signal power is being absorbed and attenuated by the electromagnetic wave absorber 22. The microwave signal, reflected by the short-circuiting circuit 25, passes through the rectangular waveguide portion 23 where the electromagnetic wave absorber 22 is provided, and reaches the front 24 while part of the signal power is being absorbed by the electromagnetic wave absorber 22 again. In this case, by setting the length L, height H, and width W of the electromagnetic wave absorber 22, and the distance D between the electromagnetic wave absorber 22 and the short-circuiting circuit 25 so that the above two reflected signals have equal amplitudes and inverse phases, the two reflected signals are canceled by each other and a nonreflective terminator is realized.

Figure 18:
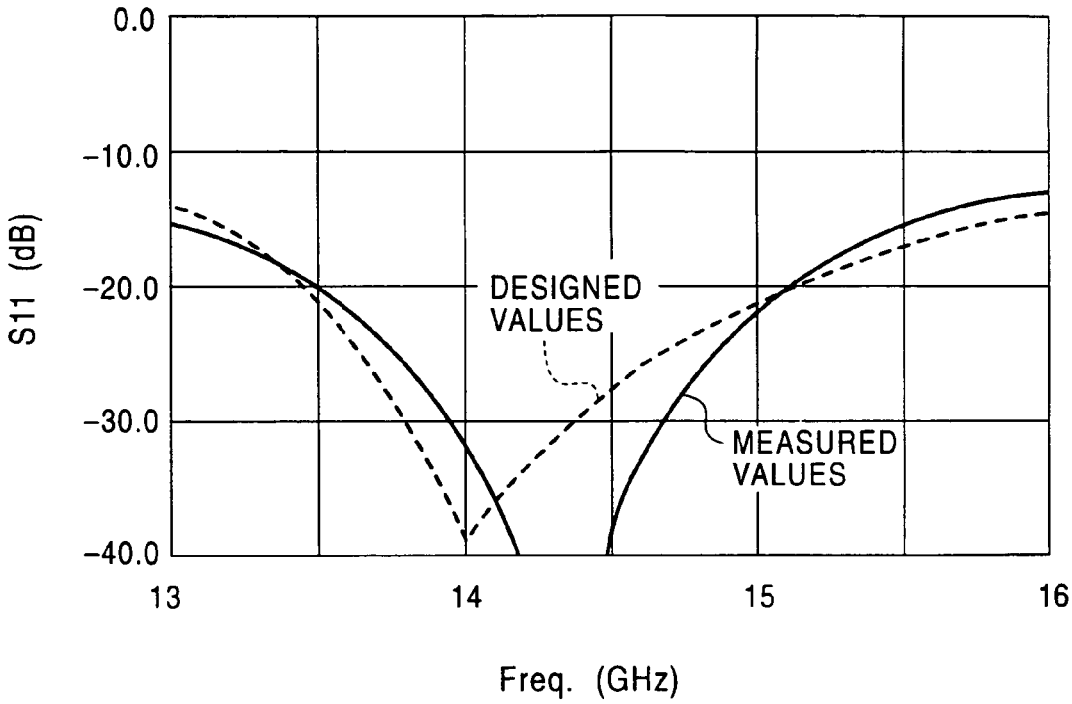
FIG. 18 is a graph showing characteristics of the nonreflective waveguide terminator according to the first embodiment.
Figure 19A:
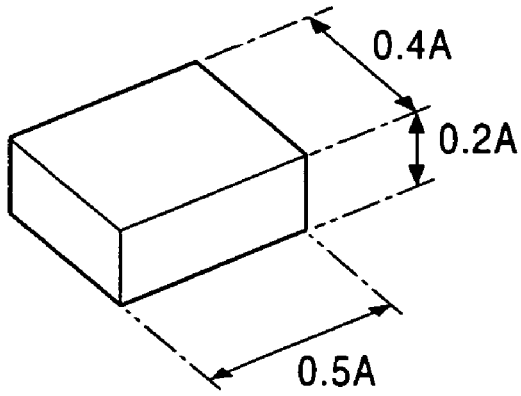
FIGS. 19A and 19B are perspective views for comparison in size of the electromagnetic wave absorber and the nonreflective waveguide terminator according to the first embodiment and an electromagnetic wave absorber.
Figure 19B:
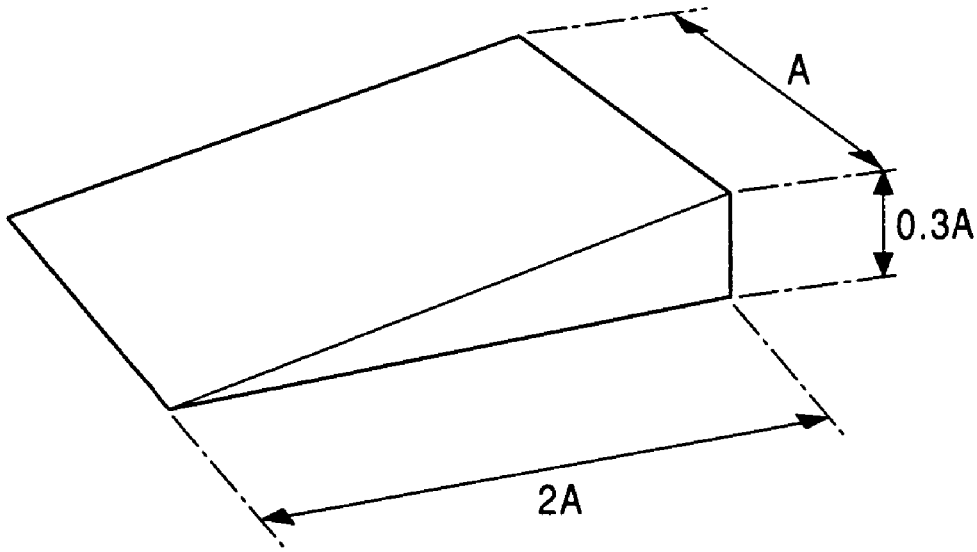

FIG. 18 is a graph showing the S11 characteristic (reflection loss) of a nonreflective waveguide terminator using the electromagnetic wave absorber according to the present invention. Regarding both designed and measured values of S11 in the range of 13.5 GHz to 15 GHz, a good reflection characteristic of −20 dB or less is realized. FIGS. 19A and 19B are perspective views for comparison in size of the electromagnetic wave absorber for use in the nonreflective waveguide terminator of the present invention and a tapered electromagnetic wave absorber for use in a nonreflective waveguide terminator of the related art. FIGS. 19A and 19B show examples of dimensions in a case in which the width of the waveguide of the related art (the width of the shorter side direction) is represented by symbol A. In order to obtain radio-wave absorbing performance similar to that of the electromagnetic wave absorber of the related art, the volume of the electromagnetic wave absorber according to the present invention is approximately one-fifteenth that of the electromagnetic wave absorber of the related art. This realizes remarkable size reduction.

Figure 16:
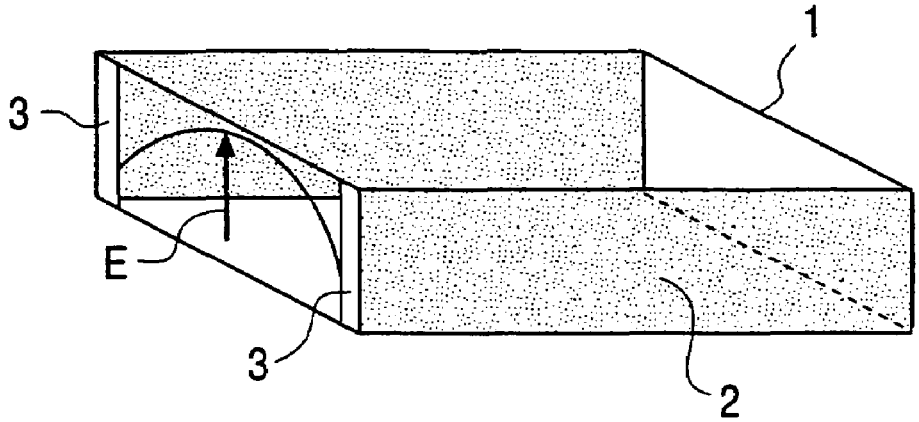
FIG. 16 is a perspective view showing a common nonreflective waveguide terminator.
Figure 17:
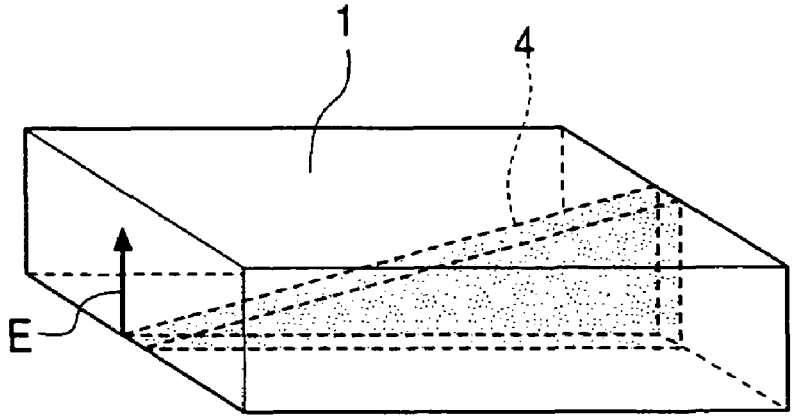
FIG. 17 is a perspective view showing a common nonreflective waveguide terminator.

Accordingly, the structure of the nonreflective waveguide terminator according to the first embodiment of the present invention is characterized by reduced size and weight, and good reflection characteristics because it is not required that the electromagnetic wave absorbers 3 be reduced in thickness for an increased length so that reflection is reduced, as in the case in FIG. 16 of the related art. Also, in this structure, since the electromagnetic wave absorber 22 in FIG. 1 can be provided against the wall surface of the waveguide in a large area, a heat radiating effect can be maintained and good high-power tolerant characteristics can be obtained. Moreover, the electromagnetic wave absorber 22 only needs to have a small volume and is a simple parallelepiped. Thus, one advantage is that, even if resin-mixed or ceramic electromagnetic-wave-absorbing material is used, the required molding cost can be reduced.

A signal reflected in the back 26 of the rectangular waveguide portion 23 where the electromagnetic wave absorber 22 is provided is obtained after the signal is attenuated by the electromagnetic wave absorber 22. The reflected signal is smaller than that from the short-circuiting circuit 25. Thus, in the above operation principle, an effect of the reflected signal is ignored for brevity of description. Although FIG. 1 shows that the electromagnetic wave absorber 22 is in contact not only with the plane perpendicular to the electric field in the waveguide portion 23, but also with the wall surface parallel to the electric field in the waveguide portion 23, if the electromagnetic wave absorber 22 is positioned away from the wall surface, the position of the electromagnetic wave absorber 22 has no relation to the gist of the present invention. Also, although FIG. 1 shows that the electromagnetic wave absorber 22 is positioned at a distance D from the short-circuiting circuit 25 as the terminating metal internal wall, the technical idea of the present invention can be applied to even a case (corresponding to D=0) in which the electromagnetic wave absorber 22 is provided against the terminating metal internal wall.

Figure 3:
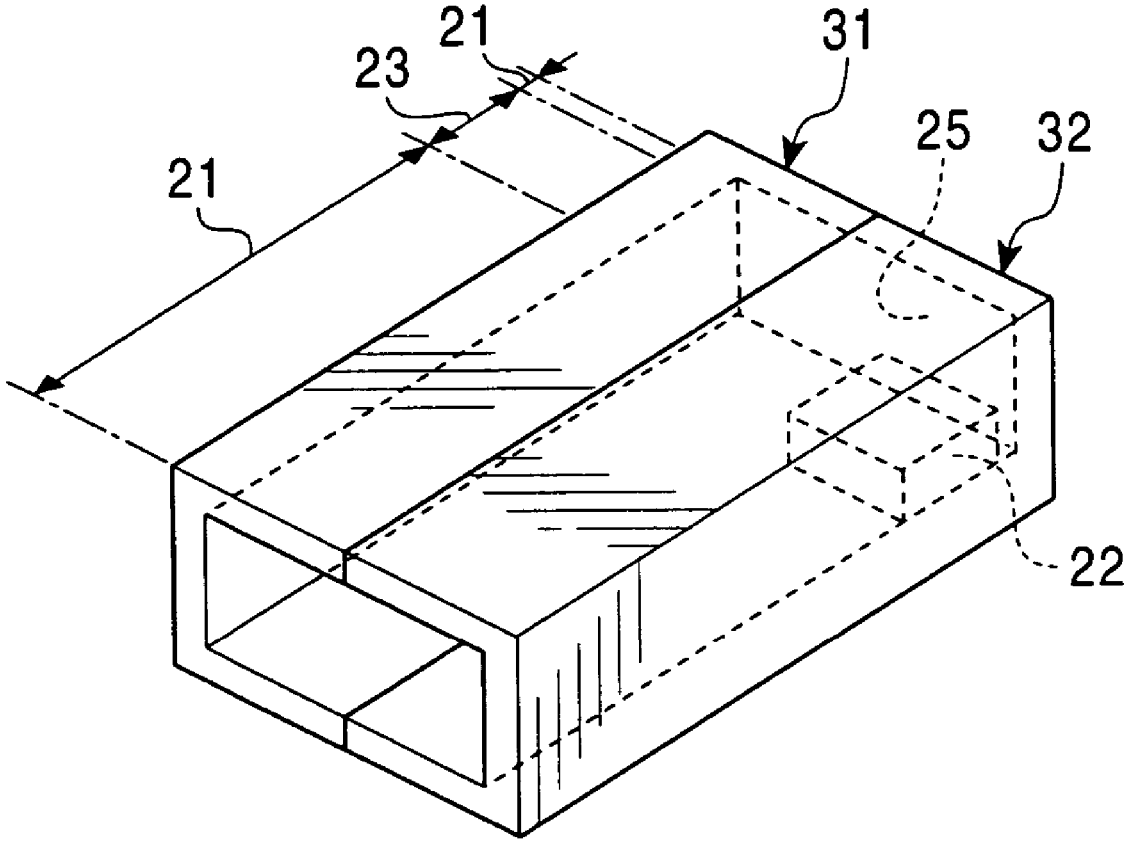
FIG. 3 is a perspective view showing another nonreflective waveguide terminator according to the first embodiment.
Figure 4:
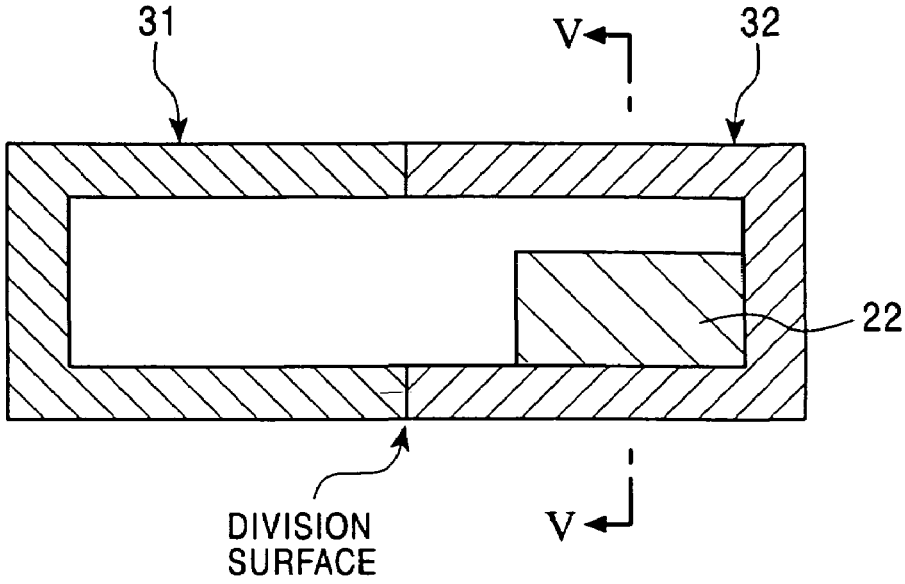
FIG. 4 is a cross-sectional view showing the other nonreflective waveguide terminator according to the first embodiment.
Figure 5:
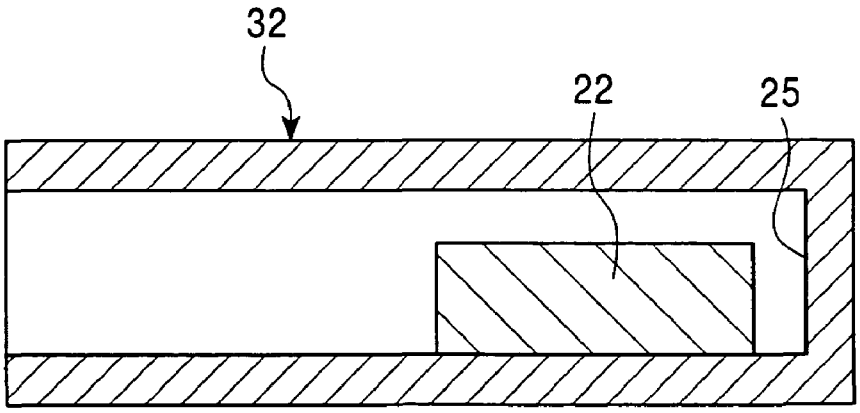
FIG. 5 is a cross-sectional view taken on line V—V of the nonreflective waveguide terminator shown in FIG. 4.
Figure 6:
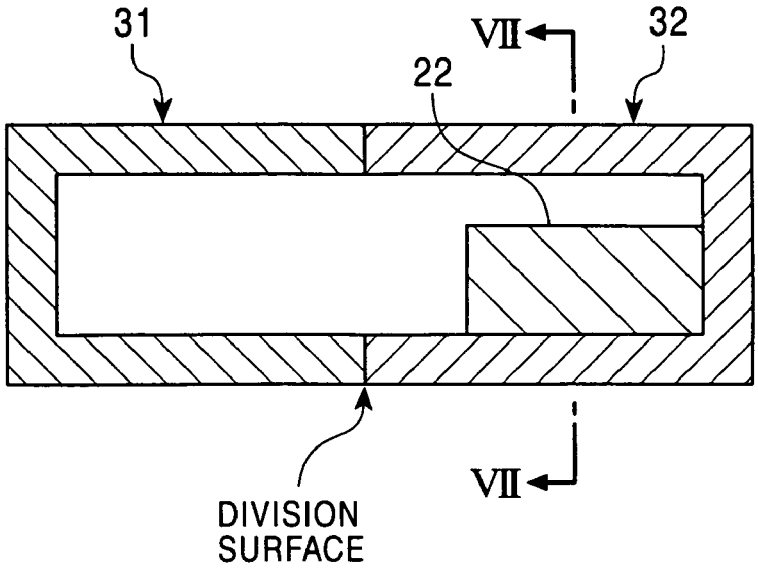
FIG. 6 is a cross-sectional view showing the nonreflective waveguide terminator according to the first embodiment.

In the above description, the waveguide portions 21 and 23 are formed in an integrated manner. However, as FIG. 3 shows, the division surface between the waveguide portions 21 and 23 is used as a plane parallel (referred to also as an "E plane") with the electric field, and two divided waveguide parts 31 and 32 along the centerline may constitute the rectangular waveguide 1. In this case, the electromagnetic wave absorber 22 is provided in the waveguide part 32, which is one of both divided waveguide parts. FIGS. 4 and 6 are cross-sectional views showing the rectangular waveguide portion 23. FIG. 5 is a sectional view taken on line V—V of the nonreflective waveguide terminator shown in FIG. 4.

The electromagnetic wave absorber 22 is fixed only to the waveguide part 32 by using an adhesive. Thus, the electromagnetic wave absorber 22 does not exist on the division surface, and positional adjustment with the other waveguide part 31 does not need to be considered. This facilitates assembly and shortens an assembly time. In addition, the division on the E plane produces an advantage in that, in the rectangular waveguide portion 21 other than the rectangular waveguide portion 23 where the electromagnetic wave absorber 22 is provided, a high frequency current flowing on the waveguide internal wall is not cut off, thus preventing the radio waves from leaking.

Therefore, the nonreflective waveguide terminator having the above structure has features in that the assembly cost is reduced by assembly simplification based on the E plane division structure and that electric performance is stabilized by preventing the radio waves from leaking from a circuit other than an electromagnetic wave absorber. The divided waveguide parts 31 and 32 can be used for assembly by using fastening with screws, an adhesive, or soldering, similarly to a waveguide part of the related art.

Figure 7:
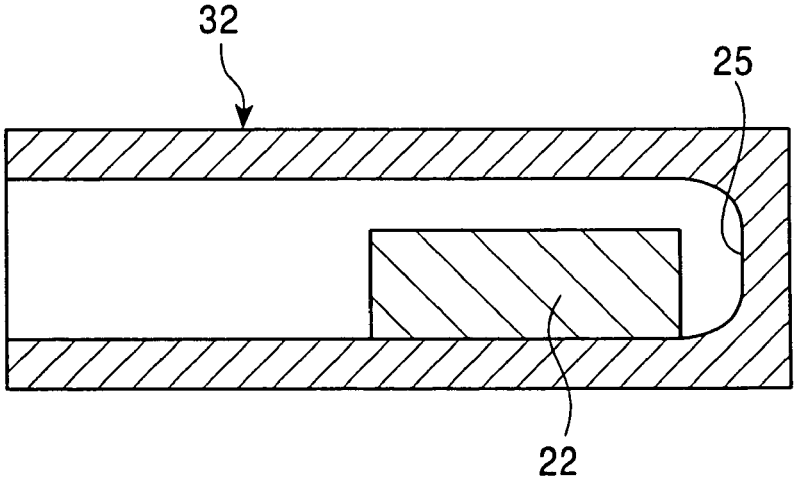
FIG. 7 is a cross-sectional view taken on line VII—VII of the nonreflective waveguide terminator shown in FIG. 6.

In the above description, the corners of the internal wall surfaces of the waveguide parts 31 and 32 have right angles. However, as FIG. 7 shows, the corners of the short-circuiting circuit 25, etc., may be rounded, and advantages similar to those in the case in FIG. 3 can be obtained. Processing of the waveguide parts 31 and 32 so as to have rounded corners can be easily performed by using a tool such as an end mill, thus enabling reduction in processing time and costs. Also, in the case of molding, the operation of taking the waveguide parts 31 and 32 out of a mold can be smoothly performed, thus enabling reduction in processing time and costs.

Figure 8:
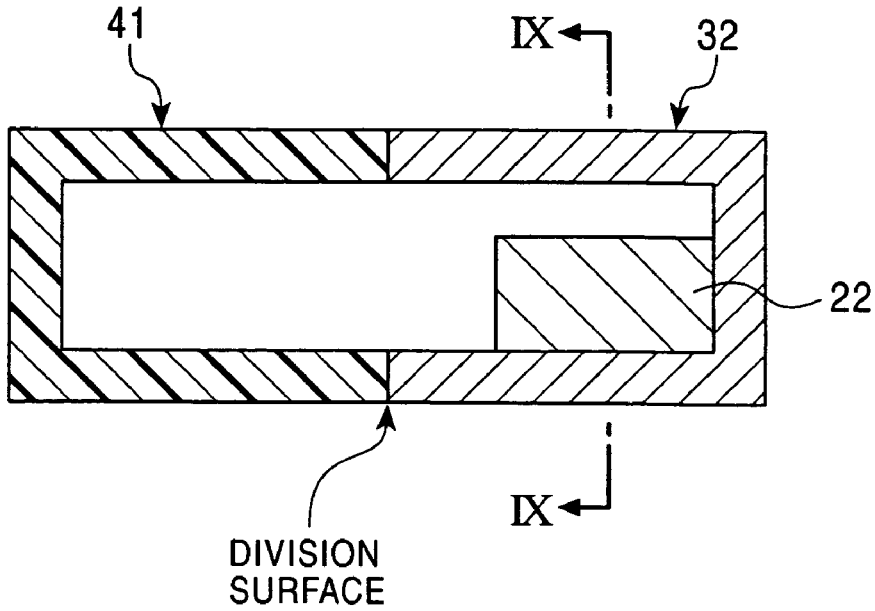
FIG. 8 is a cross-sectional view showing the nonreflective waveguide terminator according to the first embodiment.
Figure 9:
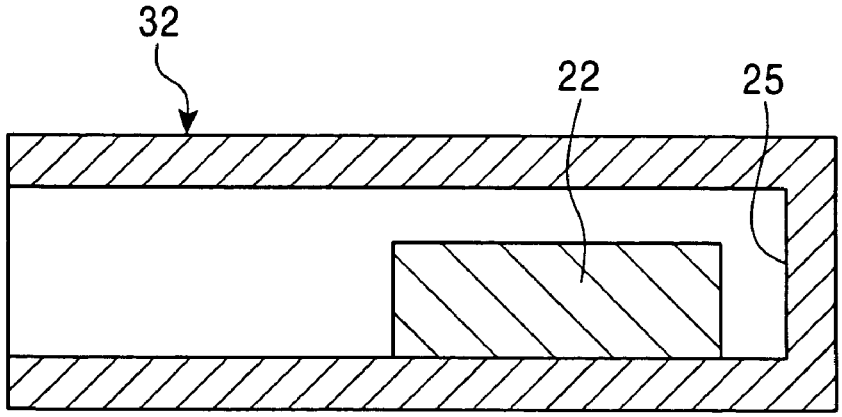
FIG. 9 is a cross-sectional view taken on line IX—IX of the nonreflective waveguide terminator shown in FIG. 8.

In the above description, the waveguide is made of metal. However, as FIGS. 8 and 9 show, in the division structure, one waveguide part 32 in which the electromagnetic wave absorber 22 is provided may be made of metal, and the other waveguide part 41 may be made of nonmetal material such as resin whose surface is metal-plated. This case has advantages similar to those in the above structure.

According to the nonreflective waveguide terminator having this structure, each resin part can be produced by molding. Thus, accuracy of the dimensions of the molded part can be increased than a molded metal part produced by aluminum die-casting. This enables mass production, and reduced cost and weight, while maintaining high electric performance such as a low reflection. Also, since the heat of high frequency power, absorbed by the electromagnetic wave absorber 22, can be radiated to the exterior through the waveguide part 32, which is made of metal, a problem of heat radiation, caused by low heat conductivity of resin, can be solved. Therefore, an advantage is obtained in that, despite the use of nonmetal material for the waveguide part 41, tolerance to high power can be also maintained.

Figure 10:
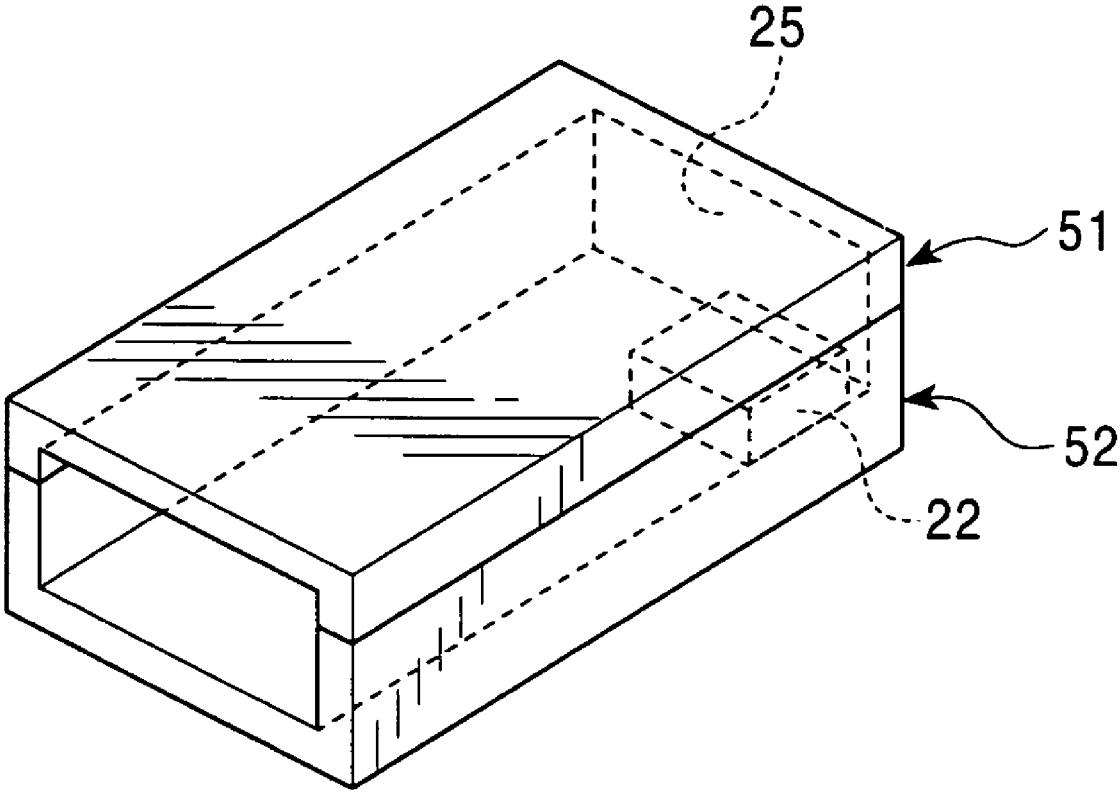
FIG. 10 is a perspective view showing the nonreflective waveguide terminator according to the first embodiment.

Although the above description is directed to the E plane division structure, as FIG. 10 shows, the division surface between waveguide parts 51 and 52 may be used as a surface parallel to the magnetic field, and an electromagnetic wave absorber may be provided on one of the waveguide part 52. This case also has advantages similar to those in the first embodiment.

Second Embodiment

Figure 11:
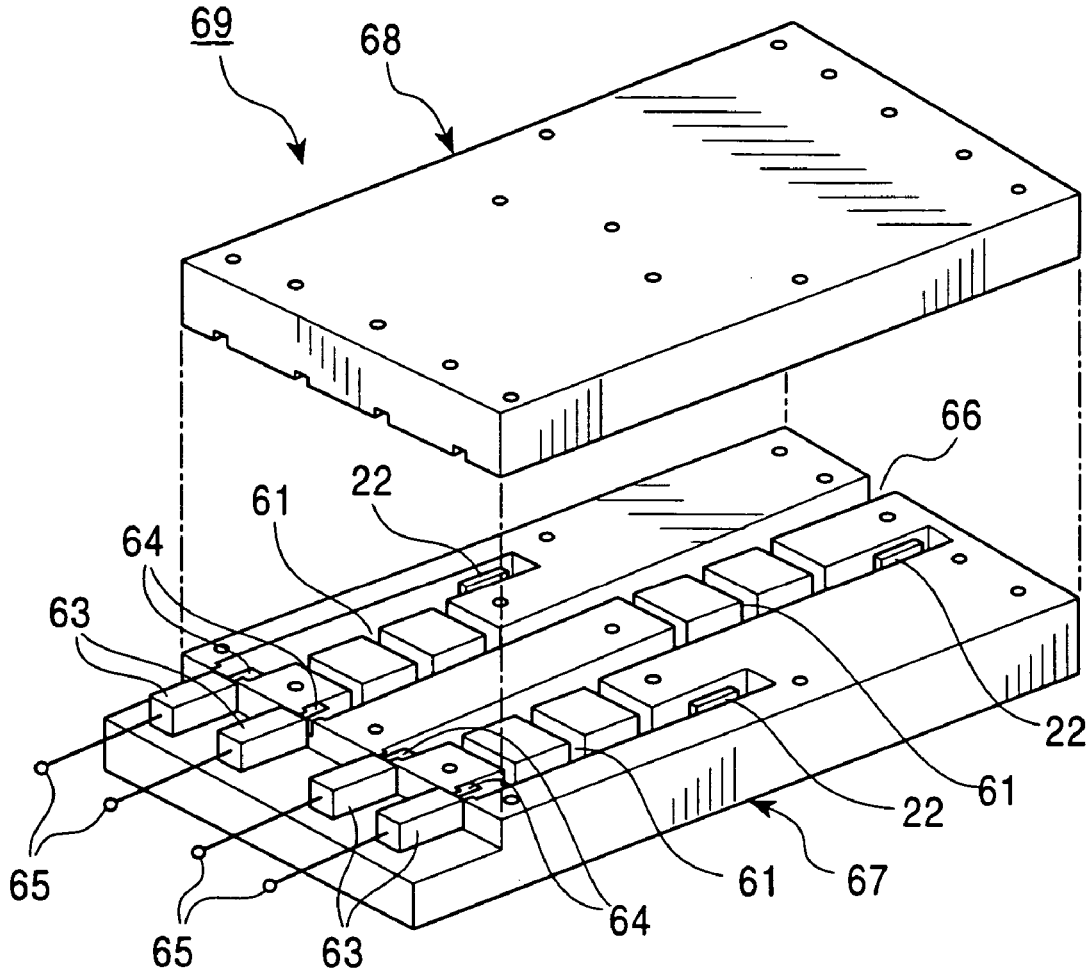
FIG. 11 is a perspective view showing a waveguide circuit according to a second embodiment of the present invention.

Although the first embodiment only describes functional parts of the nonreflective waveguide terminator, the nonreflective waveguide terminator has similar advantages if it is formed in an integrated manner with a waveguide portion having another function. By way of example, FIG. 11 shows an output power combining circuit 69 including four amplifying elements 63 used as microwave amplifiers. The output power combining circuit 69 includes input ports 65 such as microstrip lines, the amplifying elements 63 such as microwave semiconductors, conversion circuits 64 between output transmission lines of the amplifying elements 63, and a waveguide, a waveguide combining circuit 61 such as a 3-dB-90-degree branch line hybrid, and an output terminal 66 of the waveguide. The waveguide circuits having functions are constituted by waveguide circuit parts 67 and 68 which are divided on an E plane.

Figure 12:
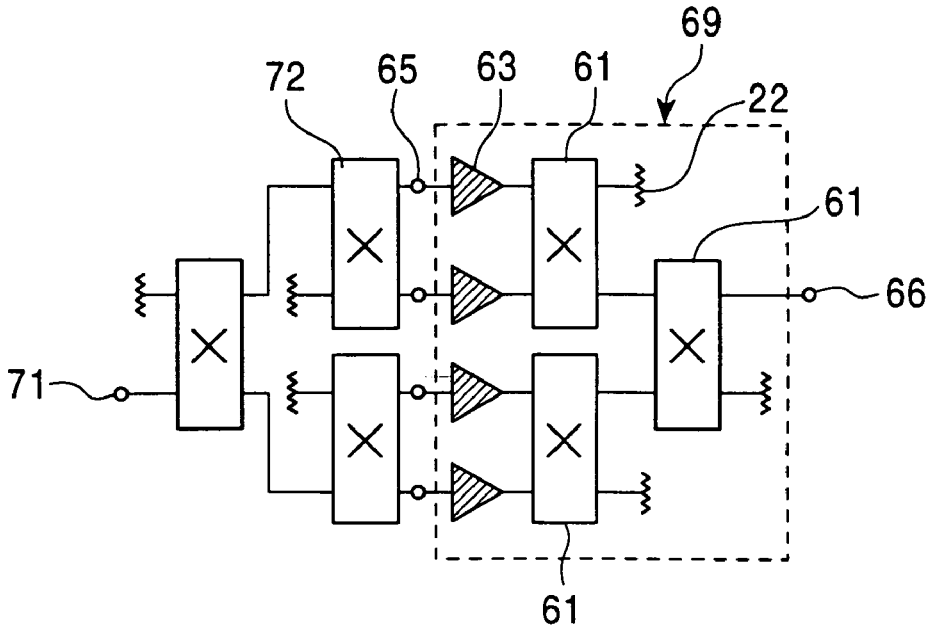
FIG. 12 is a block circuit diagram showing the waveguide circuit according to the second embodiment.
Figure 13:
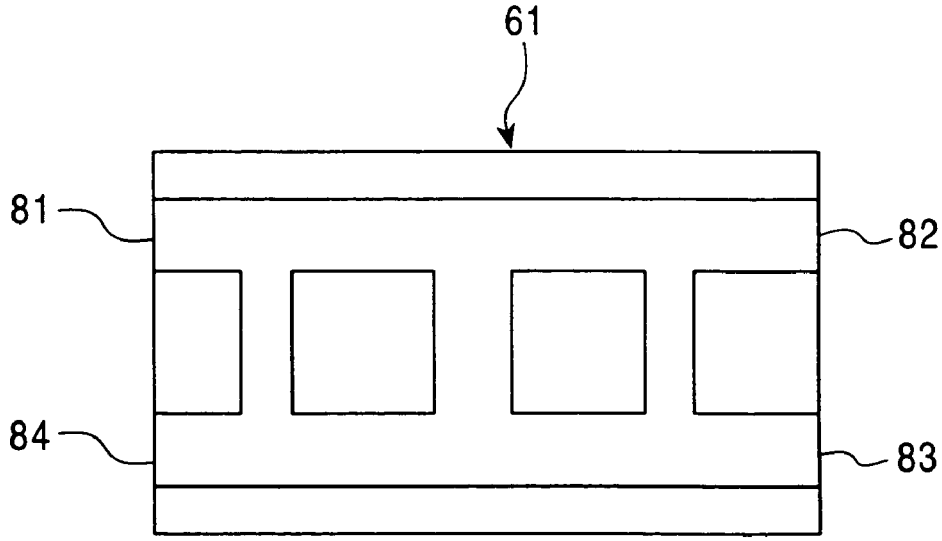
FIG. 13 is an illustration of the structure of a waveguide combining circuit constituting the waveguide circuit according to the second embodiment.
Figure 14:
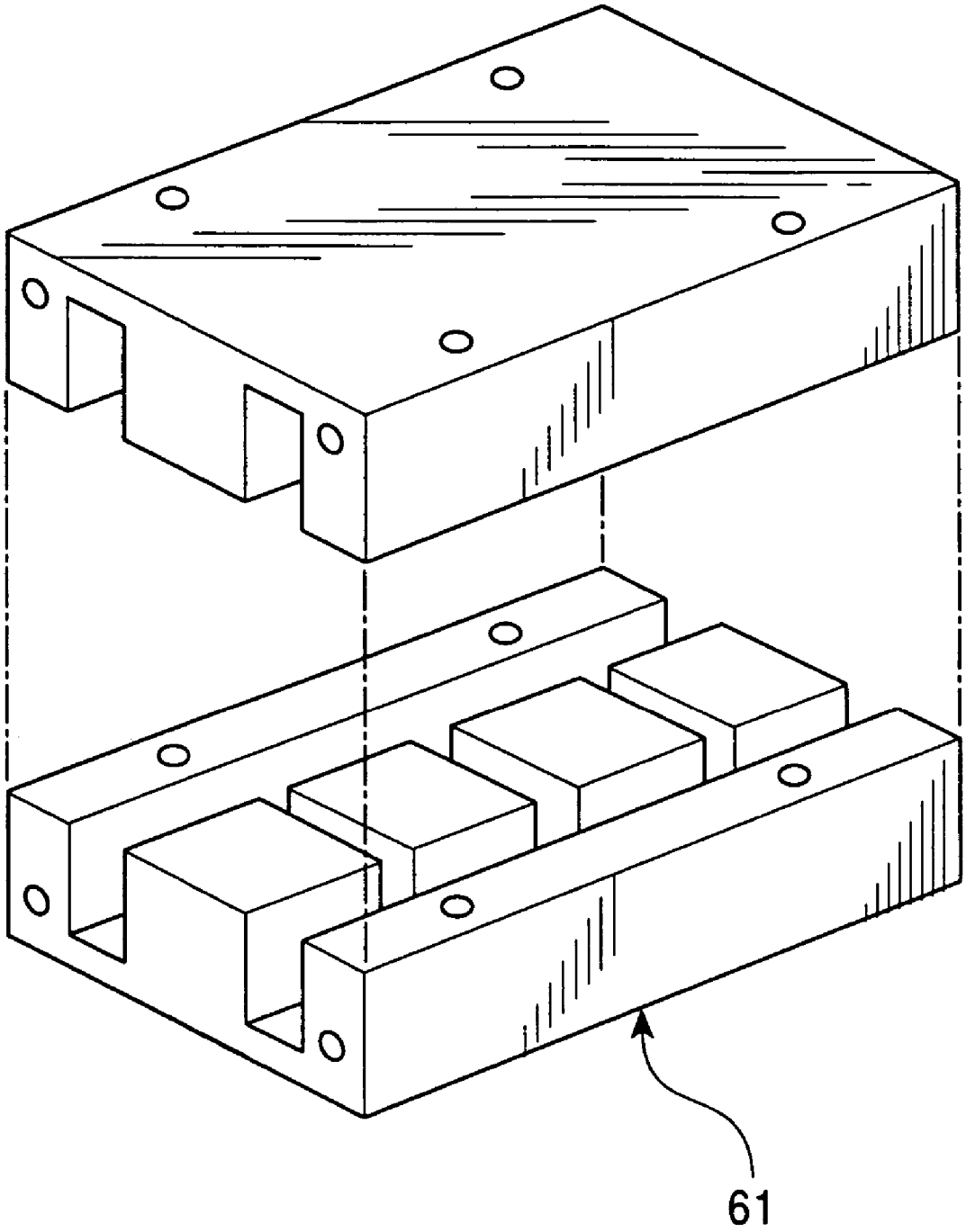
FIG. 14 is a perspective view showing the structure of the waveguide combining circuit constituting the waveguide circuit according to the second embodiment.

FIGS. 12, 13, and 14 are illustrations of the operation of the second embodiment of the present invention. FIGS. 13 and 14 show sections of the waveguide combining circuit 61 such as a 3-dB-90-degree branch line hybrid. FIG. 13 is a top view of the division surface. FIG. 14 is an exploded perspective view. FIG. 13 shows terminals 81 to 84. The powers of two equal-amplitude microwave signals which are incident from the terminals 81 and 84 are combined when the waves of the signal from the terminal 84 lag in phase behind the waves of the signal from the terminal 81, and the combined signal is output from the terminal 83. Ideally, the terminal 82 is an isolation terminal and no microwave signal appears. However, at the terminal 82, a signal appears which represents an electromagnetic vector difference caused by a shift from a 90-degree phase difference between two waves or a shift from the equal amplitude.

FIG. 12 is a block diagram showing an amplifying circuit using four amplifying elements 63. The amplifying circuit includes an input port 71 and 3-dB-90-degree distribution circuits 72. A microwave signal incident on the input port 71 is separated by the 3-dB-90-degree distribution circuits 72, and the separated signals are incident on input ports 65 of an output power combining circuit 69 including the four amplifying elements 63. In this case, when the three 3-dB-90-degree distribution circuits 72 are arranged as shown in FIG. 12, microwave signals amplified by the amplifying elements 63 are combined by three waveguide combining circuit 61, and the combined signal is output to an output terminal 66.

The above configuration is for a commonly used power-combining method in a case in which the saturation power of each amplifying element 63 is limited and an output power higher than the power is required. In other words, if the upper output power of each amplifying element 63 is 1 W, the configuration produces an output of 4 W, which is four times the output of 1 W. In this circuit, a signal which is caused by a shift in phase or amplitude in the amplifying elements 63, the 3-dB-90-degree distribution circuits 72, or the waveguide combining circuits 61, appears at an isolation terminal, as described above. The signal is absorbed by the electromagnetic wave absorber 22 of the nonreflection terminator which is connected to the amplifying circuit.

According to a waveguide circuit based on the structure in the second embodiment, the E division surface structure integrates waveguide portions having a plurality of functions. Thus, not only advantages similar to those in the above configuration can be obtained, but also advantages can be obtained in that the required costs are reduced by a reduced processing cost and simplified assembly, and that electric performance is stabilized by preventing radio waves from leaking from a circuit other than a portion in which an electromagnetic wave absorber is provided.

In addition, in the above description, the waveguide circuit parts 67 and 68 are made of metal. However, in the division structure, the waveguide circuit part 76 in which the electromagnetic wave absorber 22 and the amplifying elements 63 are provided may be made of metal, and the other waveguide circuit part 68 may be made of nonmetal material such as resin whose surface is metal-plated. This case has advantages similar to those in the above structure.

According to the waveguide circuit having the above structure, each resin part can be produced by molding. Thus, accuracy of the dimensions of the molded part can be increased than a molded metal part produced by aluminum die-casting. This enables mass production, and reduced cost and weight while maintaining high electric performance such as a low reflection. Also, heat generated by the amplifying elements 63 and the heat of the high frequency power which is absorbed by the electromagnetic wave absorber 22 can be radiated to the exterior through the waveguide circuit part 67, which is made of metal, so that a problem of heat radiation, caused by low heat conductivity of resin, can be solved. Therefore, an advantage is obtained in that, despite the use of nonmetal material for the waveguide circuit part 68, tolerance to high power can be also maintained.

Figure 15:
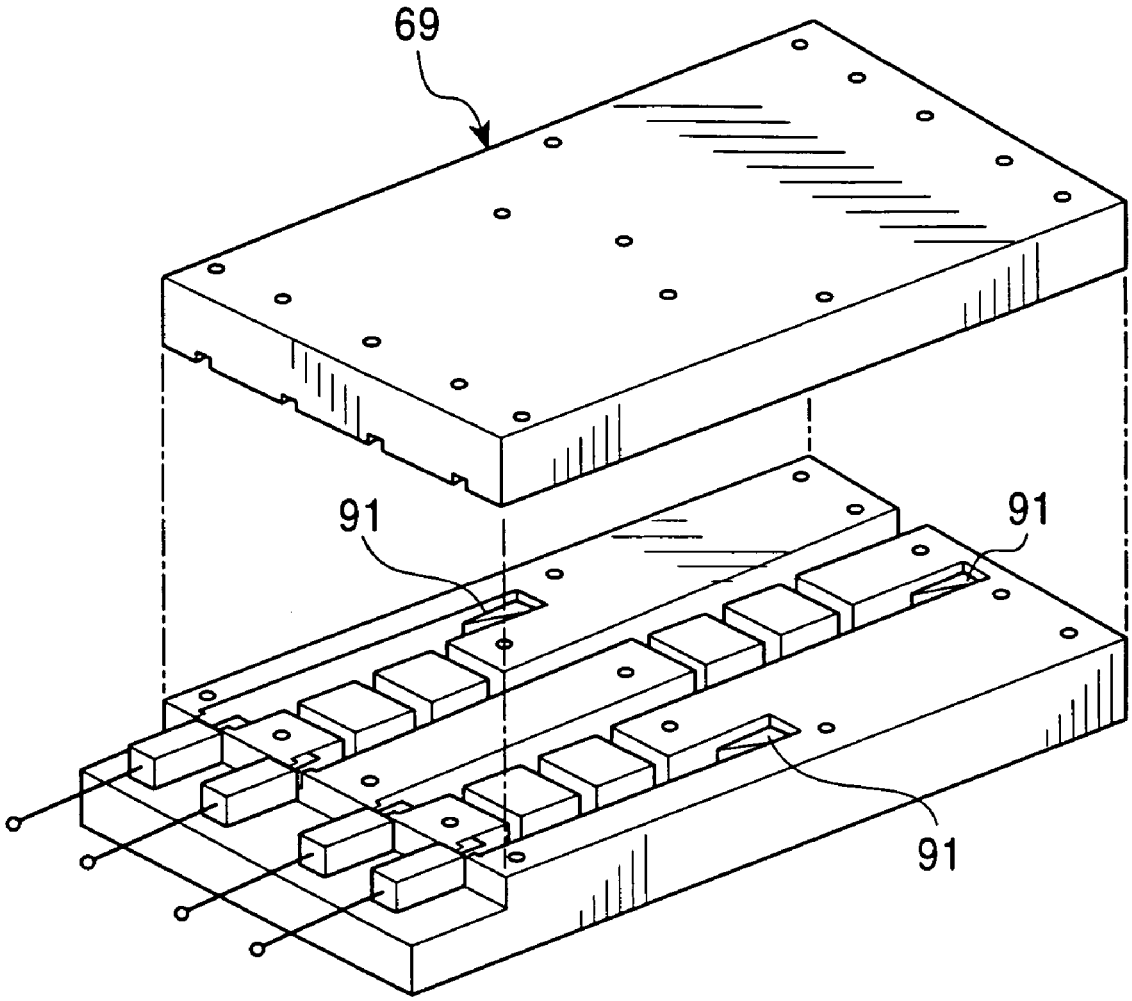
FIG. 15 is a perspective showing another waveguide circuit according to the second embodiment.

In the above description, the electromagnetic wave absorber 22 is parallelepiped. However, by also using tapered electromagnetic wave absorbers 91 as shown in FIG. 15, advantages similar to those in the above structure can be obtained.

What is claimed is:

1. A nonreflective waveguide terminator comprising:

a waveguide portion having a rectangular opening in a plane perpendicular to a radio-wave propagation direction, said waveguide portion having one open end in the radio-wave propagation direction and the other end closed by a terminating metal internal wall, said waveguide portion having a radio-wave propagation space surrounded by a first metal internal wall and a second metal internal wall opposite thereto which include the shorter sides of the rectangular opening and which are parallel to a radio-wave electric field, and a third metal internal wall and a fourth metal internal wall opposite thereto which include the longer sides of the rectangular opening and which are perpendicular to the radio-wave electric field; and an electromagnetic wave absorber whose exterior shape is a parallelepiped, said electromagnetic wave absorber having a rectangular rear-end surface which is positioned at a predetermined distance from the terminating metal internal wall and parallel to the terminating metal internal wall, the surface of said electromagnetic wave absorber, which has the largest rectangular area, being on one of the third metal internal wall and the fourth metal internal wall.

2. A nonreflective waveguide terminator according to claim 1, wherein:

said waveguide portion is formed by first and second divided parts which are provided along the center lines of the third metal internal wall and the fourth metal internal wall, and which are parallel to both the first metal internal wall and the second metal internal wall; and said electromagnetic wave absorber is placed on only one of the first divided part and the second divided part.

3. A nonreflective waveguide terminator according to claim 2, wherein:

the first divided part is made of metal material;

the second divided part is made of nonmetal material having a metal plated surface; and said electromagnetic wave absorber is placed on the first divided part.

4. A waveguide circuit including a plurality of waveguide functional portions, the waveguide functional portions each including a nonreflective waveguide terminator comprising:

a waveguide portion having a rectangular opening in a plane perpendicular to a radio-wave propagation direction, said waveguide portion having one open end in the radio-wave propagation direction and the other end closed by a terminating metal internal wall, said waveguide portion having a radio-wave propagation space surrounded by a first metal internal wall and a second metal internal wall opposite thereto which include the shorter sides of the rectangular opening and which are parallel to a radio-wave electric field, and a third metal internal wall and a fourth metal internal wall opposite thereto which include the longer sides of the rectangular opening and which are perpendicular to the radio-wave electric field; and an electromagnetic wave absorber whose exterior shape is a parallelepiped, said electromagnetic wave absorber having a rectangular rear-end surface which is positioned at a predetermined distance from the terminating metal internal wall and parallel to the terminating metal internal wall, the surface of said electromagnetic wave absorber, which has the largest rectangular area, being on one of the third metal internal wall and the fourth metal internal wall.

5. A waveguide circuit according to claim 4, wherein:

said waveguide portion is formed by first and second divided parts which are provided along the center lines of the third metal internal wall and the fourth metal internal wall, and which are parallel to both the first metal internal wall and the second metal internal wall; and said electromagnetic wave absorber is placed on only one of the first divided part and the second divided part.

6. A waveguide circuit according to claim 5, wherein:

the first divided part is made of metal material;

the second divided part is made of nonmetal material having a metal-plated surface; and said electromagnetic wave absorber is placed on the first divided part.

7. A nonreflective waveguide terminator comprising:

a waveguide portion having a rectangular opening in a plane perpendicular to a radio-wave propagation direction, said waveguide portion having one open end in the radio-wave propagation direction and the other end closed by a terminating metal internal wall, said waveguide portion having a radio-wave propagation space surrounded by a first metal internal wall and a second metal internal wall opposite thereto which include the shorter sides of the rectangular opening and which are parallel to a radio-wave electric field, and a third metal internal wall and a fourth metal internal wall opposite thereto which include the longer sides of the rectangular opening and which are perpendicular to the radio-wave electric field; and an electromagnetic wave absorber whose exterior shape is parallelepiped, said electromagnetic wave absorber having a rectangular rear-end surface which is provided against the terminating metal internal wall, the surface of said electromagnetic wave absorber, which has the largest rectangular area, being on one of the third metal internal wall and the fourth metal internal wall, wherein said waveguide portion is formed by first and second divided parts which are provided along the center lines of the third metal internal wall and the fourth metal internal wall, and which are parallel to both the first metal internal wall and the second metal internal wall; and said electromagnetic wave absorber is placed on only one of the first divided part and the second divided part.

8. A nonreflective waveguide terminator according to claim 7, wherein:

the first divided part is made of metal material;

the second divided part is made of nonmetal material having a metal plated surface; and said electromagnetic wave absorber is placed on the first divided part.

9. A waveguide circuit including a plurality of waveguide functional portions, the waveguide functional portions each including a nonreflective waveguide terminator comprising:

a waveguide portion having a rectangular opening in a plane perpendicular to a radio-wave propagation direction, said waveguide portion having one open end in the radio-wave propagation direction and the other end closed by a terminating metal internal wall, said waveguide portion having a radio-wave propagation space surrounded by a first metal internal wall and a second metal internal wall opposite thereto which include the shorter sides of the rectangular opening and which are parallel to the radio-wave electric field, and a third metal internal wall and a fourth metal internal wall opposite thereto which include the longer sides of the rectangular opening and which are perpendicular to the radio-wave electric field; and an electromagnetic wave absorber whose exterior shape is a parallelepiped, said electromagnetic wave absorber having a rectangular rear-end surface which is provided against the terminating metal internal wall, the surface of said electromagnetic wave absorber, which has the largest rectangular area, being one of the third metal internal wall and the fourth metal internal wall, wherein said waveguide portion is formed by first and second divided parts which are provided along the center lines of the third metal internal wall and the fourth metal internal wall, and which are parallel to both the first metal internal wall and the second metal internal wall; and said electromagnetic wave absorber is placed on only one of the first divided part and the second divided part.

10. A waveguide circuit according to claim 9, wherein:

the first divided part is made of metal material;

the second divided part is made of nonmetal material having a metal-plated surface; and said electromagnetic wave absorber is placed on the first divided part.

* * * * *